US005305811A

United States Patent [19]

Schaefer

[11] Patent Number: 5,305,811

[45] Date of Patent: Apr. 26, 1994

[54] BLADE MOUNTING FOR A CHIPPER BLADE

[75] Inventor: Karl Schaefer, Lechbruck am See, Fed. Rep. of Germany

[73] Assignee: Inter-Wood-Maschinen GmbH & Co., KG, Lechbruck am See, Fed. Rep. of Germany

[21] Appl. No.: 46,847

[22] Filed: Apr. 14, 1993

[30] Foreign Application Priority Data

Jun. 13, 1992 [DE] Fed. Rep. of Germany ..... 4219447

[51] Int. Cl.[5] ..... B27C 1/00

[52] U.S. Cl. ..... 144/176; 144/218; 144/230; 407/45; 407/46; 407/48; 407/86; 241/298

[58] Field of Search ..... 407/45, 46, 48, 77, 407/86, 113; 241/92, 298; 144/39, 162 R, 172, 174, 176, 218, 229, 230

[56] References Cited

U.S. PATENT DOCUMENTS

| | | | |
|---|---|---|---|
| 1,688,913 | 10/1928 | Ahrendt | 144/230 |
| 2,702,059 | 2/1955 | Ballantine | 144/230 |
| 2,889,861 | 6/1959 | Kolimbat | 144/230 |
| 3,014,511 | 12/1961 | Kirsten | 144/230 |
| 3,542,302 | 11/1970 | Salzmann, Jr. | 241/298 |
| 3,854,511 | 12/1974 | Maier | 144/230 |
| 3,989,077 | 11/1976 | Humbert | 144/230 |
| 4,194,545 | 3/1980 | Kostermeier | 144/230 |
| 5,076,503 | 12/1991 | Cook | 144/230 |
| 5,080,153 | 1/1992 | Waterman | 144/176 |

FOREIGN PATENT DOCUMENTS

| | | |
|---|---|---|
| 3506252 | 8/1986 | Fed. Rep. of Germany . |
| 3933880 | 4/1990 | Fed. Rep. of Germany . |

*Primary Examiner*—W. Donald Bray
*Attorney, Agent, or Firm*—Foley & Lardner

[57] ABSTRACT

A blade mounting for a chipper blade of a wood-chipping machine, the chipper blade having a back and a fore-part, the blade mounting including: a disk cover-plate having an inner slope which bears against the back of the chipper blade; a blade holder having at least two grooves which are oriented perpendicular to a longitudinal axis of the blade holder and parallel to a plane of the chipper blade, the blade holder bearing against the fore-part of the chipper blade; adjusting screws located in the grooves in the blade holder; and dogs for underpinning a bottom edge of the chipper blade at at least two locations, the dogs being adjusted by the adjusting screws.

10 Claims, 3 Drawing Sheets

BLADE MOUNTING FOR A CHIPPER BLADE

BACKGROUND OF THE INVENTION

The invention relates to a blade mounting for the cutting tool of a fixed block or blade-disk chipper of a wood-chipping machine.

In the production of chips having chip thicknesses of over 0.7 mm, as are required for certain special boards, high cutting and feed forces are generated which, in the unavoidable chipping of end-grained wood sections, exert correspondingly high displacement forces on the cutting edges of full-cut blades. This is particularly true of disk chippers, whose cutting speed in the inner area of the disk is only around 35% of the cutting speed of the outer area. Most disk chippers operate at a blade setting angle, advantageous to the chip surface, of 35°. At a setting angle of 35°, the displacement forces have an even more adverse effect than in the case of setting angles of around 45°, which are also employed.

If the chipper blades are retracted during chipping, this can sometimes result in damage to the surface of the cutting tool and the blade clamping elements. In such cases, it is often not sufficient to join the chipper blade and blade holder with more than two connecting screws, particularly where the blade length exceeds 400 mm. High-capacity disk chippers, equipped with blade mountings according to German Offenlegungsschrift 39 33 880, require chipper blades of such a length where the disk diameters measure 3,000 mm or more.

U.S. Pat. No. 3,542,302 discloses a blade mounting wherein the chipper blades and the blade holders are adjusted, following regrinding, by means of adjusting screws which are inserted into the bottom edges of these elements. Assuming a universally common regrinding width of 40 mm and a 1 mm regrind in each case, 40 readjustments would need to be made. Where the chipper blades are only 4 mm thick, such an arrangement does not work.

German Offenlegungsschrift 35 06 252 discloses a blade mounting having angle brackets, the short leg of which bears with its inner surface against the bottom edge of the blade. The screw connection of the angle bracket is effected by means of adjustably disposed clamping screws, which open out into retaining bolts guided through holes in the chipper blade. In addition, a plurality of permanent magnets are housed in the blade holder. The clamping forces which can be obtained with this blade mounting are no greater than with a conventional screw connection.

SUMMARY OF THE INVENTION

An object of the invention is to provide a blade mounting which, even under the influence of high displacement forces, secures the rotating chipper blade immovably in its previously set position.

This object of the invention is achieved by a blade mounting for a chipper blade of a wood-chipping machine, the chipper blade having a back and a fore-part, the blade mounting including: a disk coverplate having an inner slope which bears against the back of the chipper blade; a blade holder having at least two grooves which are oriented perpendicular to a longitudinal axis of the blade holder and parallel to a plane of the chipper blade, the blade holder bearing against the fore-part of the chipper blade; adjusting screws located in the grooves in the blade holder; and dogs for underpinning a bottom edge of the chipper blade at at least two locations, the dogs being adjusted by the adjusting screws.

Additional objects, features and advantages of the invention will become apparent from the following description and the drawings.

BRIEF DESCRIPTION OF THE DRAWINGS

The drawings are hereby expressly made a part of the specification.

DETAILED DESCRIPTION OF THE PREFERRED EMBODIMENTS

In the following description, two embodiments of the invention are explained.

According to the present invention, by actuating the adjusting screws, the dogs are brought into contact with the bottom edge of the blade. This blade mounting can also, following each blade regrind, serve for adjusting the blade protrusion. For this purpose, the inner surfaces of the blade mounting are expediently provided with suitable permanent magnets. Where there is a danger, for example as a result of the inclusion of relatively large metal parts in the wood, of the chipping tool being considerably damaged, the adjusting screws can be provided with predetermined breaking strengths.

The blade mounting according to the invention is suitable for all blade clamping systems.

Figure 1:
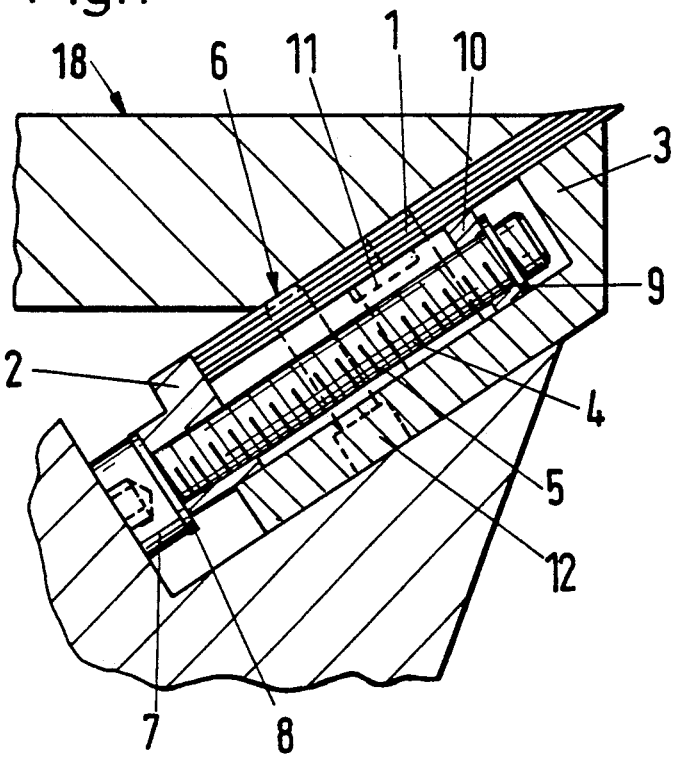
FIG. 1 shows a section through the blade mounting of a disk chipper, according to a first embodiment, in which the blade assembly includes a blade holder and blade.
Figure 2:
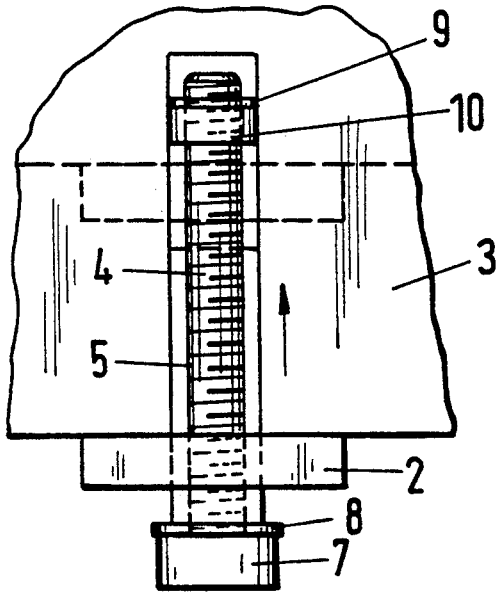
FIG. 2 shows a top view of the inner surface, bearing against the fore-part of the blade, of the blade holder, together with adjusting screw and dog.

In the case of the embodiment according to FIG. 1, the chipper blade 1 bears with its back against the inner slope 6 of a disk coverplate 18 and with its blade fore-part against a blade holder 3. The blade holder 3 is provided, at at least two locations, with grooves running transversely to its longitudinal axis, which grooves receive adjusting screws 4, the threads 5 of which are guided through dogs 2 which underpin the bottom edge of the blade as soon as the adjusting screws 4 are tightened. The screwhead 7, which in this embodiment is situated at the bottom, together with the shim 8, can also be used to determine the protrusion of the blade holder 3. The retaining washer 9 bears upon a supporting bridge 10 which is anchored firmly in the groove. The blade holder 3 is further provided with permanent magnets 11. The connecting screws 12 which were previously employed in the known blade mountings can additionally be used.

Figure 4:
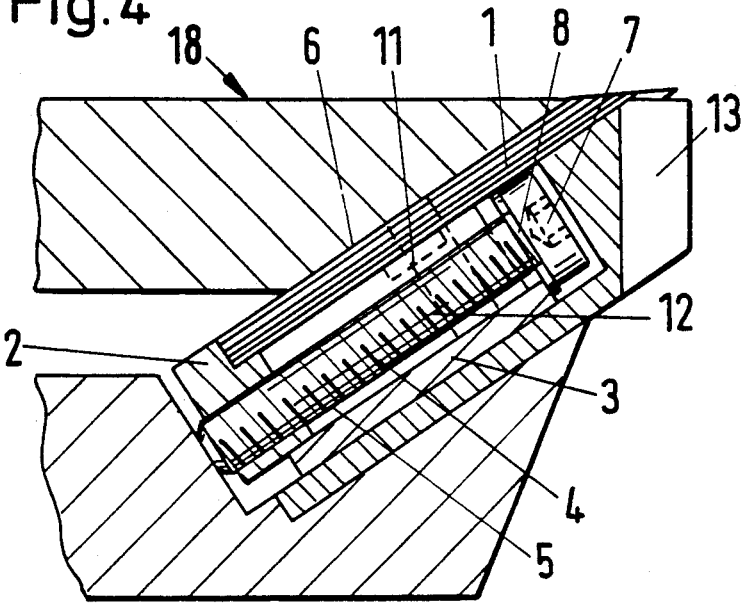
FIG. 4 shows a section through the blade mounting of a disk chipper according to a second embodiment.
Figure 3:
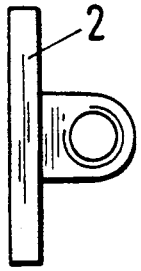
FIG. 3 shows a top view of a dog.
Figure 5:
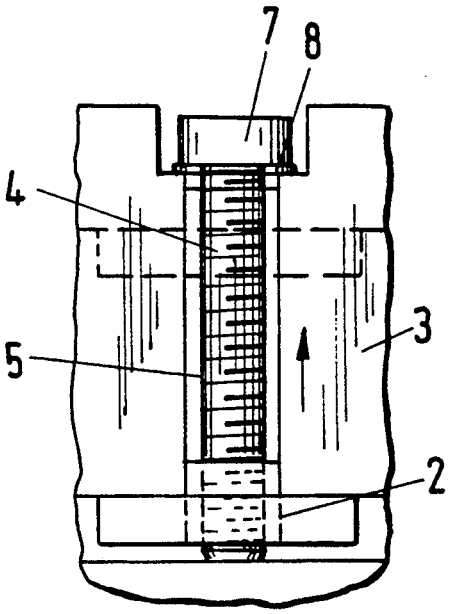
FIG. 5 shows a top view of the inner surface, bearing against the fore-part of the blade, of the blade holder, together with adjusting screw and dog.

In the case of the embodiment according to FIGS. 4 and 5, the chipper blade 1 likewise bears with its back against the inner slope 6 of a disk coverplate 18 and with its blade fore-part against a blade holder 3, which is additionally enclosed, however, by a chip flow bar with a wood support 13. The screwhead 7 with the shim 8 is in this embodiment situated in the top part of the blade holder 3, the dog 2 in the bottom part. If the adjusting screw 4 is guided beyond the bottom edge of the dog 2, it can also be used for determining the protrusion of the blade holder 3. In this illustrative embodiment also, additional connecting screws 12 and permanent magnets 11 can be employed.

Figure 6:
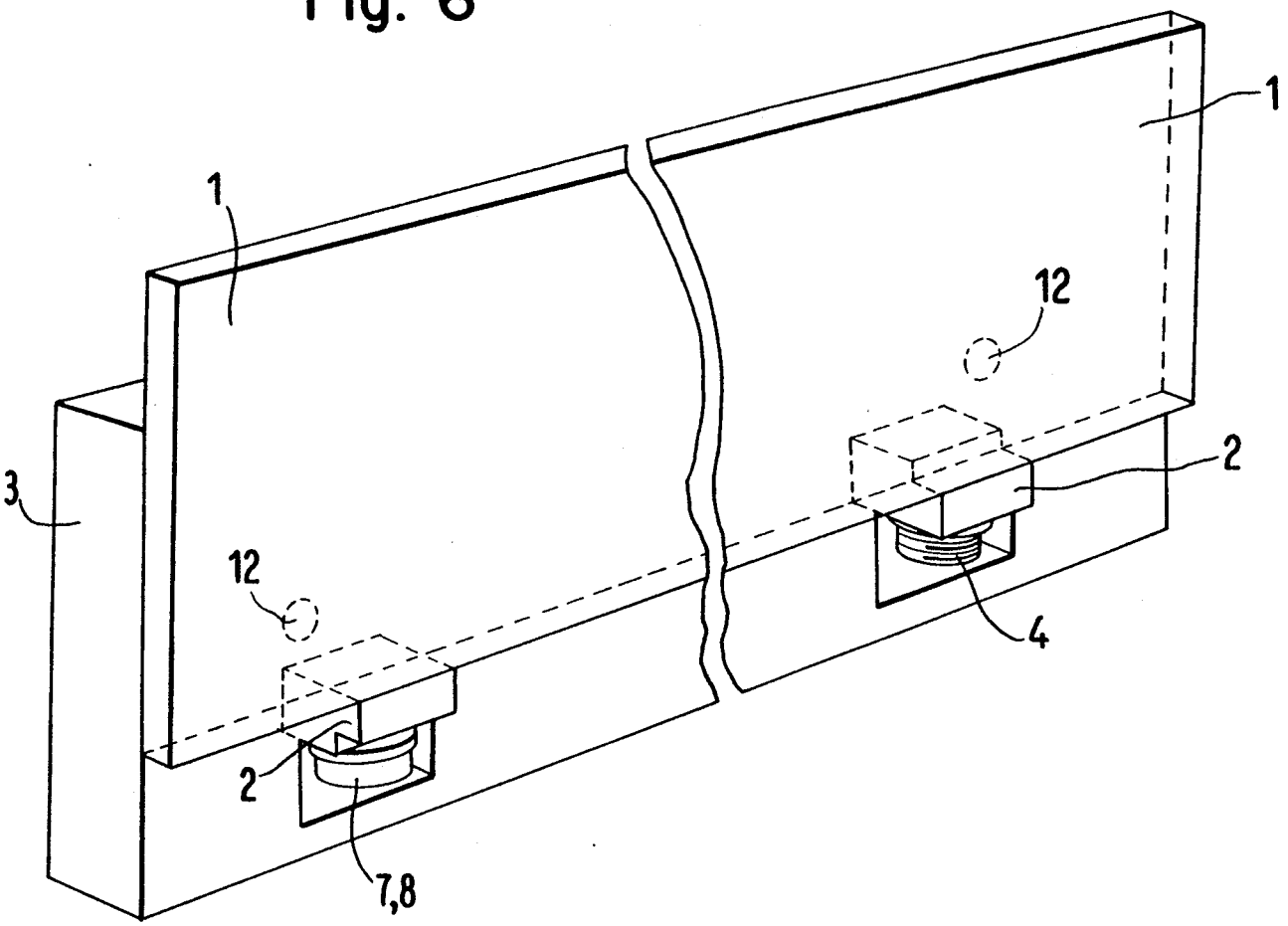
FIG. 6 shows a partial perspective view of the blade mounting of the present invention.

FIG. 6 shows a perspective view of the blade mounting that includes dogs 2 at two locations. The left-hand side of FIG. 6 shows a dog 2 in accordance with the embodiment of FIG. 1 and the right-hand side of FIG. 6 shows a dog 2 in accordance with the embodiment of FIG. 4.

Although the invention has been described by reference to certain preferred embodiments, numerous modifications and alterations are possible without departing from the spirit and scope of the appended claims, and equivalents thereof.

What is claimed is:

1. A blade mounting for a chipper blade of a wood-chipping machine, the chipper blade having a back and the fore-part, the blade mounting comprising:

a disk coverplate having an inner slope which bears against the back of the chipper blade;

a blade holder having at least two grooves which are oriented perpendicular to a longitudinal axis of the blade holder and parallel to a plane of the chipper blade, the blade holder bearing against the fore-part of the chipper blade;

adjusting screws located in the grooves in the blade holder; and dogs for underpinning a bottom edge of the chipper blade at at least two locations, the dogs being adjusted by the adjusting screws.

2. The blade mounting of claim 1 wherein the adjusting screws have a predetermined breaking strength to prevent damage to the chipper blade.

3. The blade mounting of claim 1, wherein heads of the adjusting screws are located at a bottom of the blade holder.

4. The blade mounting of claim 3, further comprising shims located adjacent the heads of the adjusting screws.

5. The blade mounting of claim 3, further comprising supporting bridges anchored in the grooves, and retaining washers which bear upon the supporting bridges, the adjusting screws being inserted through the retaining washers.

6. The blade mounting of claim 1, further comprising a permanent magnet located on an inner surface of the blade mounting.

7. The blade mounting of claim 1, further comprising a connecting screw for connecting the blade holder to the chipper blade.

8. The blade mounting of claim 1, further comprising a chip flow bar having a wood support, the chip flow bar enclosing the blade holder.

9. The blade mounting of claim 8, wherein heads of the adjusting screws are located at a top of the blade holder.

10. The blade mounting of claim 9, further comprising shims located adjacent the heads of the adjusting screws.

* * * * *